US007004515B2

(12) United States Patent
Timothy

(10) Patent No.: US 7,004,515 B2
(45) Date of Patent: Feb. 28, 2006

(54) FENESTRATION LOCKING SYSTEM

(75) Inventor: E. Erik Timothy, Macedon, NY (US)

(73) Assignee: Caldwell Manufacturing Company, Rochester, NY (US)

( * ) Notice: Subject to any disclaimer, the term of this patent is extended or adjusted under 35 U.S.C. 154(b) by 0 days.

(21) Appl. No.: 10/154,246

(22) Filed: May 23, 2002

(65) Prior Publication Data

US 2002/0180218 A1 Dec. 5, 2002

Related U.S. Application Data

(60) Provisional application No. 60/294,533, filed on May 30, 2001.

(51) Int. Cl.
*E05C 1/02* (2006.01)

(52) U.S. Cl. ..... 292/137; 292/36; 292/38; 292/97; 292/141; 292/336.3; 292/DIG. 20; 292/DIG. 47; 74/102; 74/502.2

(58) Field of Classification Search ..... 292/137, 292/141, 38, 302, 341.15, 97, 98, DIG. 20, 292/DIG. 47, DIG. 36, 336.3, 36, 37, 28, 292/50, 253, 40, 161; 74/99 R, 101–103, 74/491, 500.5, 501.6, 502.2
See application file for complete search history.

(56) References Cited

U.S. PATENT DOCUMENTS

| | | | | |
|---|---|---|---|---|
| 345,779 | A * | 7/1886 | Gilman | 292/218 |
| 552,950 | A * | 1/1896 | Abbott et al. | 292/1 |
| 555,368 | A * | 2/1896 | Gardner et al. | 292/169 |
| 915,001 | A * | 3/1909 | Webber | 292/228 |
| 919,311 | A * | 4/1909 | Bollbach | 292/279 |
| 1,056,803 | A * | 3/1913 | Lackland | 292/229 |
| 1,136,254 | A * | 4/1915 | Mosler | |
| 1,141,286 | A * | 6/1915 | Takacs | 292/335 |
| 1,866,684 | A | 7/1932 | Van Der Leun | |
| 2,148,050 | A * | 2/1939 | Moseley | 292/1 |
| 2,548,578 | A | 4/1951 | Andersson et al. | 292/141 |
| 2,731,286 | A * | 1/1956 | Bandy | 292/5 |
| 2,967,595 | A * | 1/1961 | Zitomer | 49/450 |

(Continued)

FOREIGN PATENT DOCUMENTS

| | | | |
|---|---|---|---|
| DE | 622511 | * | 1/1994 |

(Continued)

*Primary Examiner*—Brian E. Glessner
*Assistant Examiner*—Carlos Lugo
(74) *Attorney, Agent, or Firm*—Brown & Michaels, PC
Eugene S. Stephens & Associates

(57) ABSTRACT

This fenestration locking system for a swinging sash or door is characterized by the use of a linear member running continuously from an actuating assembly to a locking pin assembly. The linear member can be a flexible linear member, allowing it to convey motion to the locking pin assembly around corners. The locking pin assembly has a moveable locking pin with an actuator and an extension that can engage a keeper. The linear member has multiple actuator engagement sites along its length where the actuator of the locking pin can engage the linear member. The linear member can then be used to move the locking pin with respect to the locking pin assembly so that the extension can engage or disengage a keeper. The locking pin assembly can be mounted on a fenestration frame and the keeper opposingly mounted on a window or door mounted in the fenestration frame. Alternately, the keeper can be incorporated into the fenestration frame and the locking pin assembly opposingly mounted on the window or door mounted in the fenestration frame.

35 Claims, 17 Drawing Sheets

U.S. PATENT DOCUMENTS 2,970,855 A * 2/1961 Fisher ..... 292/59
3,159,205 A * 12/1964 Varacalli ..... 160/209
3,589,759 A * 6/1971 Bercheux ..... 16/232
4,002,360 A * 1/1977 Frank et al. ..... 292/336.3
4,199,176 A 4/1980 Kelly ..... 292/38
4,602,457 A 7/1986 Kreusel ..... 49/192
4,610,472 A * 9/1986 Billingsley ..... 292/54
4,618,177 A * 10/1986 Schultz ..... 292/338
4,739,583 A 4/1988 Tonsmann et al. ..... 49/192
4,803,808 A * 2/1989 Greisner ..... 49/394
4,807,914 A 2/1989 Fleming et al. ..... 292/48
4,887,392 A 12/1989 Lense ..... 49/300
4,937,976 A 7/1990 Tucker et al. ..... 49/345
5,118,145 A * 6/1992 Tucker ..... 292/158
5,152,103 A 10/1992 Tucker et al. ..... 49/279
5,201,557 A * 4/1993 Schlack ..... 292/161
5,318,333 A * 6/1994 Dreifert ..... 292/336.3
5,329,869 A 7/1994 Freeman et al. ..... 114/117
5,370,428 A 12/1994 Dreifert et al. ..... 292/161
5,533,798 A 7/1996 Feldpausch et al. ..... 312/219
5,593,190 A * 1/1997 Shepard ..... 292/98
5,927,767 A 7/1999 Smith et al. ..... 292/158
5,992,907 A 11/1999 Sheldon et al. ..... 292/34
6,135,511 A * 10/2000 Smith et al. ..... 292/156
6,161,881 A * 12/2000 Babka et al. ..... 292/26
6,230,457 B1 * 5/2001 Brautigam ..... 52/204.69
6,367,853 B1 * 4/2002 Briggs ..... 292/336.3
6,431,620 B1 * 8/2002 Tremblay et al. ..... 292/263
6,607,221 B1 * 8/2003 Elliott ..... 292/33
6,651,389 B1 * 11/2003 Minter et al. ..... 49/394
6,837,004 B1 * 1/2005 Annes ..... 49/394

FOREIGN PATENT DOCUMENTS

DE 4321099 A1 * 1/1994
EP 0573819 A2 * 5/1993
GB 2270337 A * 3/1994
GB 2277958 * 11/1994

* cited by examiner

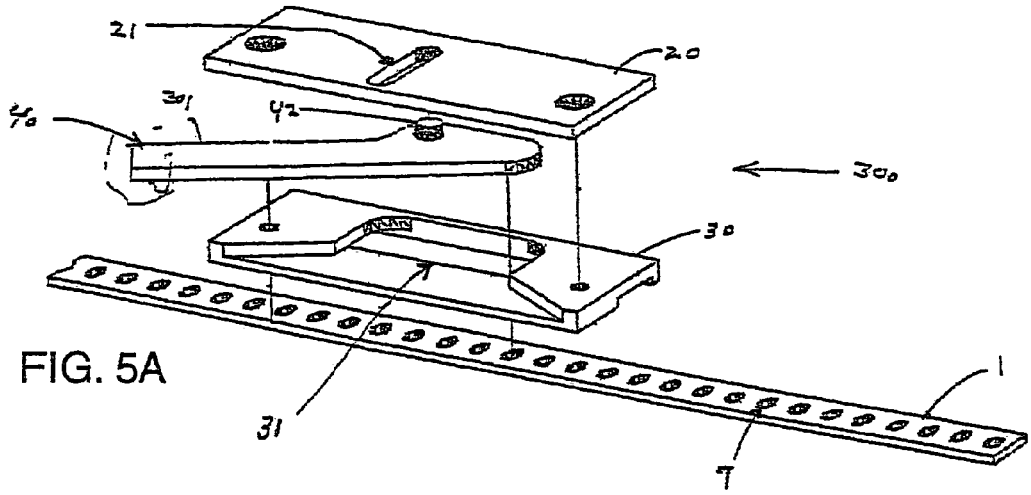
FIG. 5A
FIG. 5B
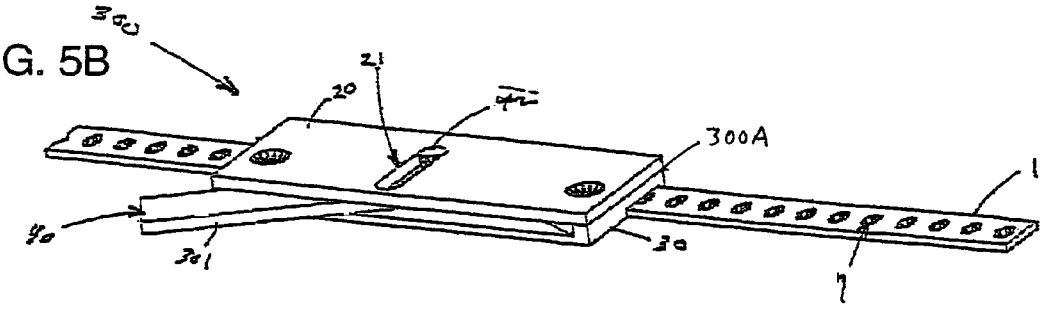
FIG. 5C
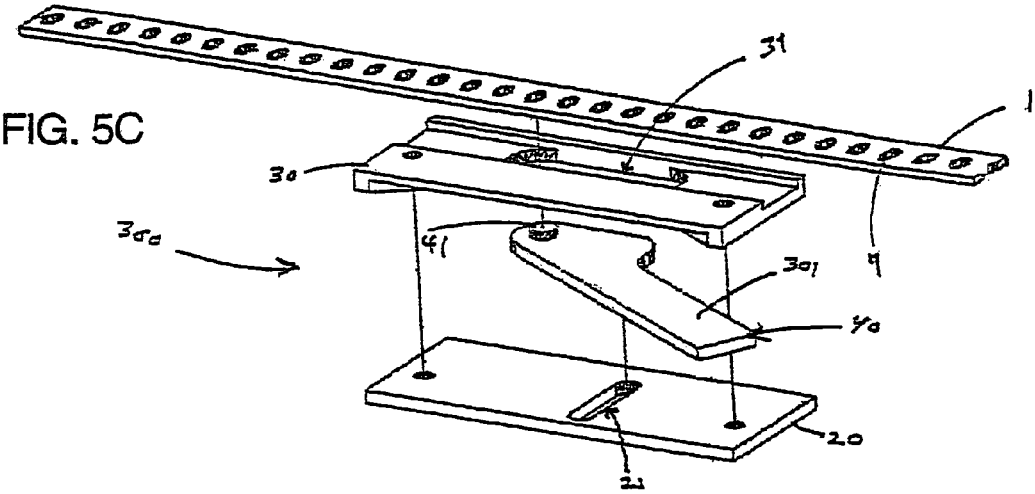

FENESTRATION LOCKING SYSTEM

This application claims the benefit of U.S. Provisional Application No. 60/294,533, filed on May 30, 2001, which Provisional application is incorporated by reference herein.

TECHNICAL FIELD

This invention deals generally with fenestration locking systems for openings having a swinging closure means such as a swinging sash, door, or gate. More specifically, it pertains to locking systems that use sliding elements to transfer locking motion, especially those using bendable sliding elements to transfer locking motion around a corner. It emphasizes systems using-a flexible push-pull member and actuating lever handle arrangements suitable for use with such systems.

BACKGROUND OF THE INVENTION

Fenestration is generally considered to include any opening in a building's envelope, including windows, doors, and skylights. The technology applicable in the fenestration context can, however, also be applicable for other enclosure openings, such as gates in walls or fences.

There are many fenestration locking systems currently in existence. Only a few of these systems use a bendable sliding element to transfer locking motion around a corner. Among systems using a bendable sliding element are sash locking systems that have a flexible cable that extends all the way around the window. In these systems, a locking element can be pulled in two directions by opposing cables for locking and unlocking purposes. However, the cables are only used in a pulling mode; they cannot be used in a pushing mode. More typical are sash locking systems that feature a flexible push-pull member at the corner of the window frame. This push-pull member serves as a bendable sliding element and can be pulled or pushed to lock or unlock a window sash. In these systems, the flexible push-pull member is generally connected to a rigid vertical locking bar carrying the locking pins for the sash. Sash locking systems also use a variety of lever handle arrangements for moving these bendable sliding elements back and forth so as to engage or disengage a sash lock.

U.S. Pat. No. 4,887,392, issued to Lense in 1989 for an "Apparatus for Actuating and Locking a Window Sash", provides an example of a design using a flexible push-pull member at a window corner. This patent uses a flexible tape that drives around the corner; but once the tape rounds the corner; it connects to a rigid locking bar that moves up and down to accomplish sash locking. The tape is also moved by an actuator that opens and closes the window, rather than by a separate lever.

Contrasting but related designs can be seen in U.S. Pat. Nos. 4,807,914 and 5,370,428. U.S. Pat. No. 4,807,914, issued to Fleming et al. in 1989 for a "Window Lock Assembly", shows a locking system driven by a perforated tape. However, this tape does not extend around a corner. It merely serves as a rack driving a pinion formed as a locking cam. U.S. Pat. No. 5,370,428, issued to Dreifert et al. in 1994 for a "Mechanism for Releasably Locking Sashes in Door or Window Frames", shows sash locking pins driven by a moving lock bar to which the pins are not attached. The pins are trapped for movement within guides that straddle or cover both sides of the locking bar.

Of the systems described above, those using a flexible member to form a bendable corner push-pull sliding element have proven to be simpler to construct and less expensive. However, there remains a need for improvements that will create a locking system that is similar in function, but even simpler to manufacture and operate than prior art devices. These improvements should also serve to create a single lever locking system that is more versatile and significantly less expensive to construct and install.

SUMMARY OF THE INVENTION

My first improvement is the use of a flexible push-pull member that can be used not only to transfer movement around a fenestration corner, but to transfer movement all the way from a distant location on the fenestration edge to a locking member. Thus, my flexible push-pull member can be used to transfer movement from a locking lever at the bottom of a window around the corner and up the side of the frame (or "jamb") to the position of the upper-most locking pin. In addition, the location of the operative parts of my invention can be reversed. For example, the flexible push-pull member and related parts can be mounted on the door or sash with keepers mounted on or incorporated into the doorframe or jamb. Further, my invention, unlike prior art devices, is capable of use around irregularly shaped windows and doors. Thus, it can easily be adapted for use around a round window or window opening.

In my invention, locking pins are not directly attached to the flexible member. In a some embodiments of my invention, the locking pins have collars or enlarged portions that trap the pins in place under slotted guides mounted on the edges of the fenestration or fenestration closure means. In other embodiments, the guide is a slotted cover strip that overlays the flexible member and locking pins. In either case, the locking pin is generally provided with a coaxial motion transmitting pin or member that extends into regularly spaced perforations in the flexible member. This eliminates any permanent connection between my locking pins and the flexible member and simplifies the installation of the pins and flexible member. It also allows the locking pins to be mounted to engage various perforations in the flexible member, depending on the dimensional requirements of the door, window, or opening in question.

I have also improved the locking lever assembly used in my invention. It has a simple three-piece structure. A lower piece has a slot that runs parallel with and above the flexible member (or "locking tape"), and the upper piece has a slot oriented transverse to the direction of movement of the locking tape. The locking lever has a drive pin that extends into the locking tape and a pivot pin that extends upward into the slot running transverse to the tape. As the lever is rotated, the pivot pin moves along the length of the transverse slot while the tape drive pin drives along the direction of movement of the tape. The arrangement provides a low mechanical advantage and higher speed movement as the locking motion is commenced, and a greatly increased mechanical advantage and slower speed movement as the locking pins are driven home to pull the sash or door snuggly into a sealed closure with its frame. The arrangement also aligns the two pins with the direction of movement of the tape. Thus, when the sash or door is locked, it is not possible to pry into the edge of the frame and push against the locking pins to move the tape to an unlocked position.

These improvements serve to create a fenestration locking system that is similar in function but simpler and more effective in installation and application than prior art devices. Indeed, all a user generally needs for implementing my invention in a window or door opening is (1) a strip of flexible member; (2) one or more of my pins; (3) pin guides; (4) a corner bracket for guiding the flexible member around sharp corners; (5) keepers for placement on frame, door, or sash; and (6) an actuating member. There is no further need for fixed length locking bars with pins mounted on the locking bars in addition to guide plates supporting such pins or locking bars. These improvements also serve to create a single lever locking system that is significantly less expensive. Indeed, my improved locking lever assembly is so compact that the locking lever can fit directly below the operator that opens and closes a sash, putting all the controls neatly in a single location and avoiding any interference with window blinds and curtains. These and the numerous other advantages of my invention will become evident upon review of the drawings and detailed description that follow.

DESCRIPTION OF THE DRAWINGS

FIGS. 1–4B illustrate an embodiment of my invention where the locking pins are held in place by slotted guides mounted on the edges of a fenestration opening.

FIG. 1 provides a perspective view of an upper locking pin assembly for this embodiment of my invention.

FIG. 2 provides a first perspective view of a lower locking pin assembly, corner guide, and locking lever assembly for this embodiment of my invention.

FIG. 3 provides a second perspective view of a lower locking pin assembly, corner guide, and locking lever assembly for this embodiment of my invention.

FIG. 4B provides a frontal view of a locking pin assembly for this embodiment of my invention.

FIGS. 5A–6G illustrate the structure, construction, and use of my locking lever.

FIG. 5A provides an exploded perspective view of a locking lever assembly of my invention.

FIG. 5B provides a perspective view of a locking lever assembly of my invention.

FIG. 5C provides an inverted exploded perspective view of a locking lever assembly of my invention.

FIG. 6G provides a schematic cross-sectional view of the locking lever assembly after it has been moved 120 degrees towards a closed position.

FIGS. 7A–7C illustrate a locking lever assembly adapted for direct use with a sash keeper, while

FIG. 7A provides an exploded perspective view of a locking lever assembly adapted for direct use with a sash keeper.

FIG. 7B provides a perspective view of the locking lever assembly illustrated in FIG. 7A in an unlocked position.

FIG. 7C provides a perspective view of the locking lever assembly illustrated in FIG. 7A in a locked position, engaging a sash keeper.

FIG. 7D provides a perspective view of a locking lever assembly positioned between and interacting with two locking pin assemblies via a rigid lock bar.

FIGS. 8A–10B illustrate embodiments of my invention where the locking pins are held in place by slotted cover strips.

FIG. 8A provides a perspective view of one of these embodiments of my invention.

FIG. 8B provides a perspective view illustrating a variation of this embodiment of my invention.

FIG. 10B provides a cross-sectional view of a second embodiment of the cover strip of my invention.

FIGS. 11A–13B illustrate additional preferred embodiments for several elements of my invention.

FIG. 11A provides an exploded perspective view of an alternative locking pin and guide.

FIG. 13B provides a perspective assembled view of the two-part locking lever with separable snap-in handle illustrated in FIG. 13A.

DESCRIPTION OF THE INVENTION

Figure 1:
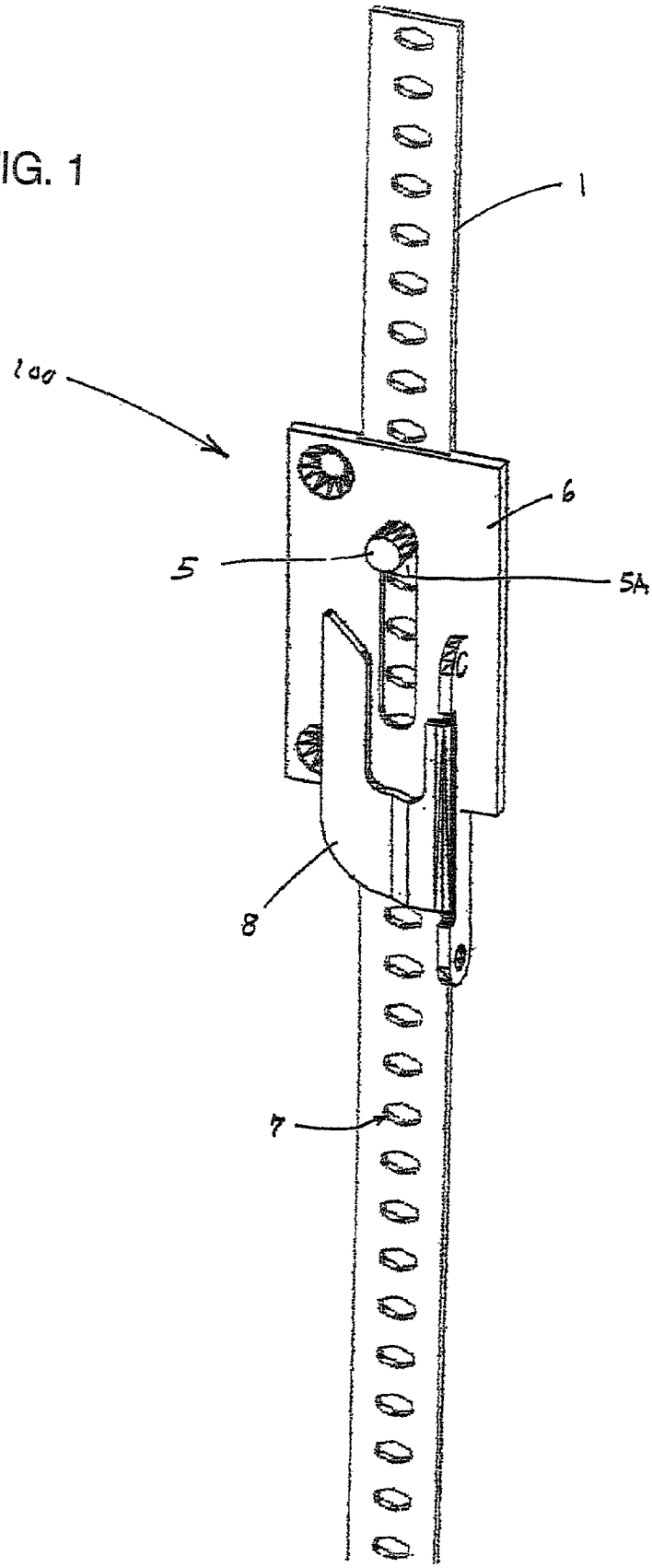
Figure 2:
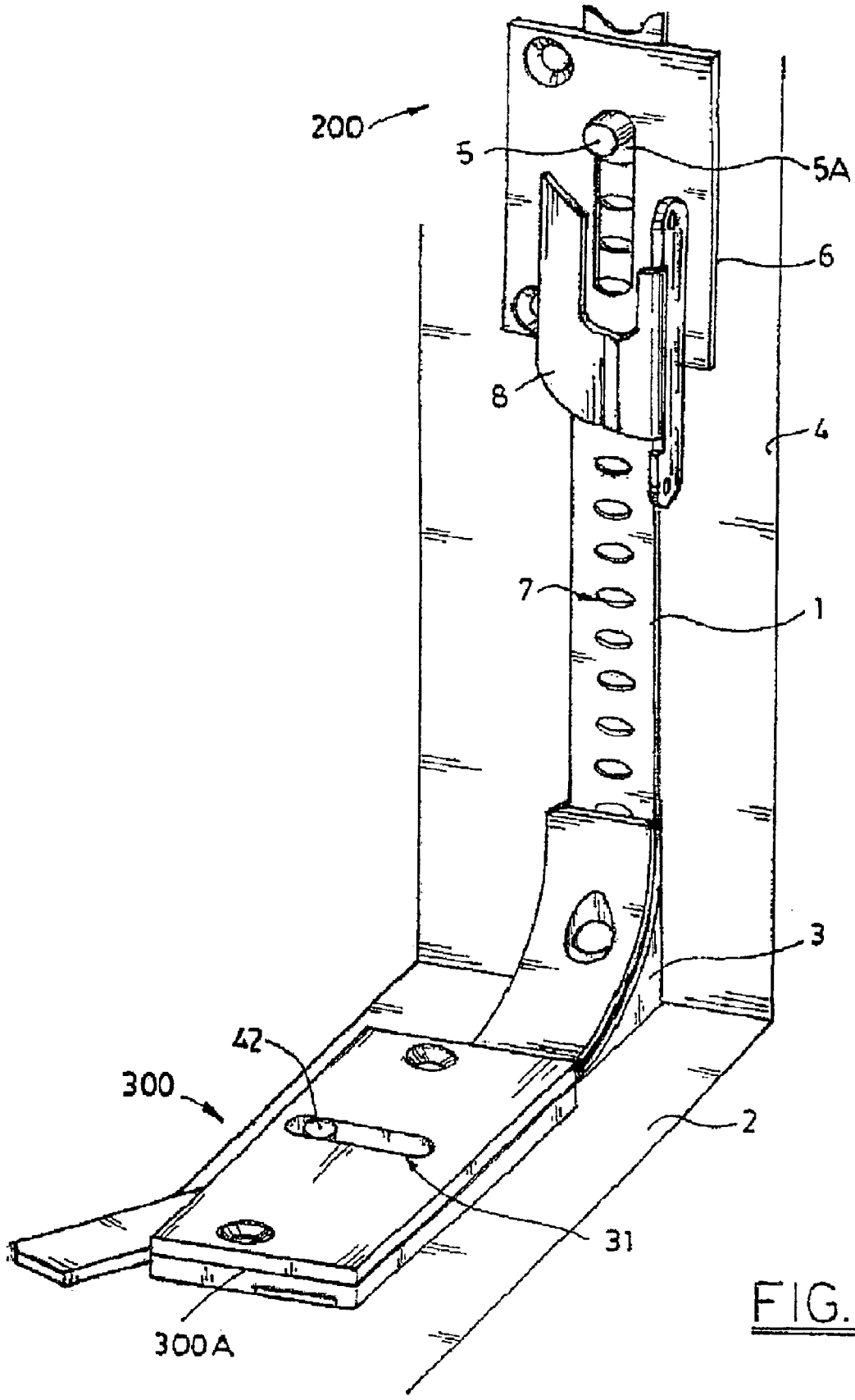
Figure 3:
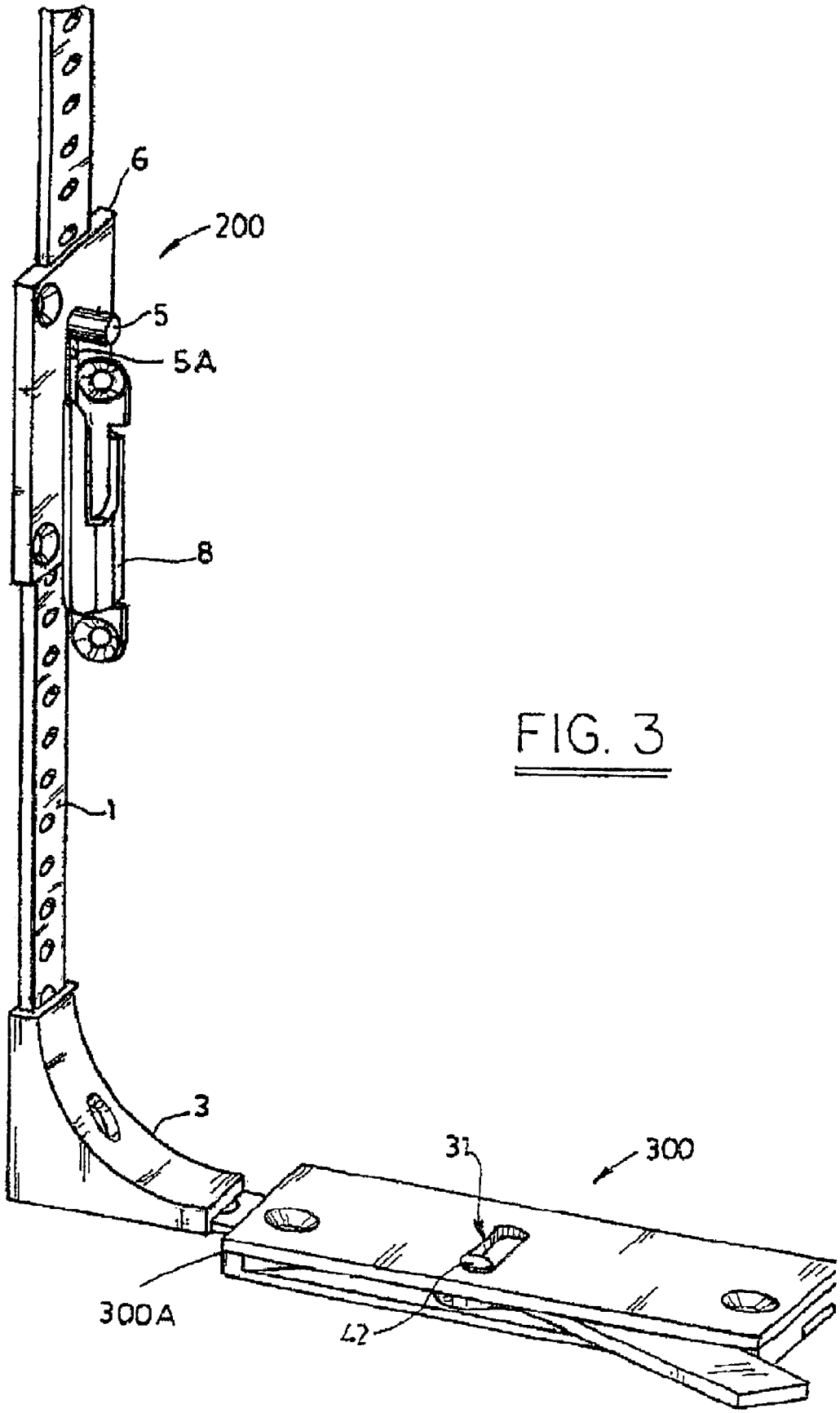
Figure 4A:
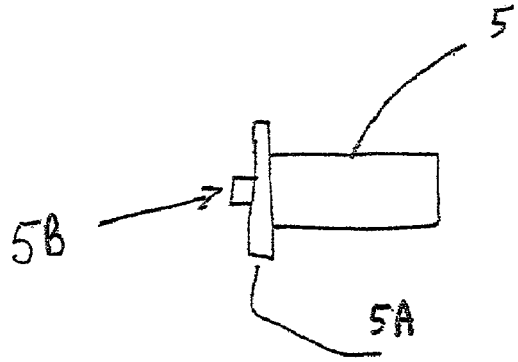
FIG. 4A provides a side view of a locking pin for this embodiment of my invention.
Figure 4B:
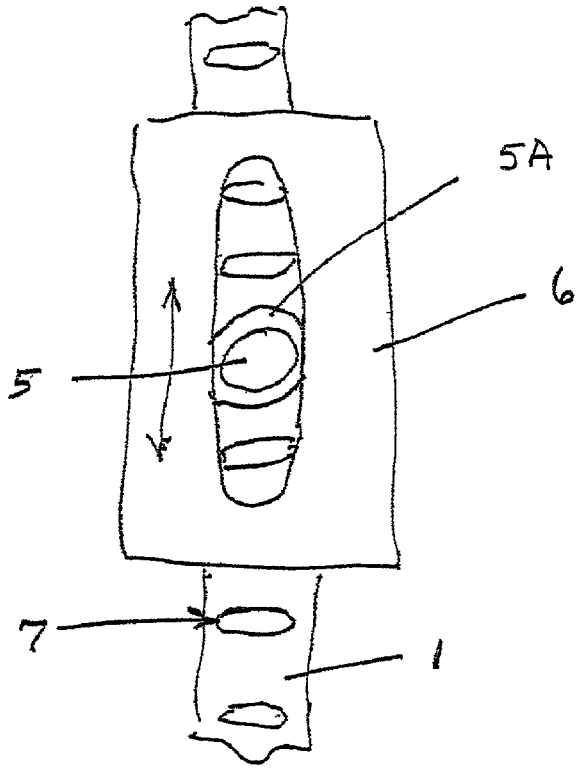
Figure 6A:
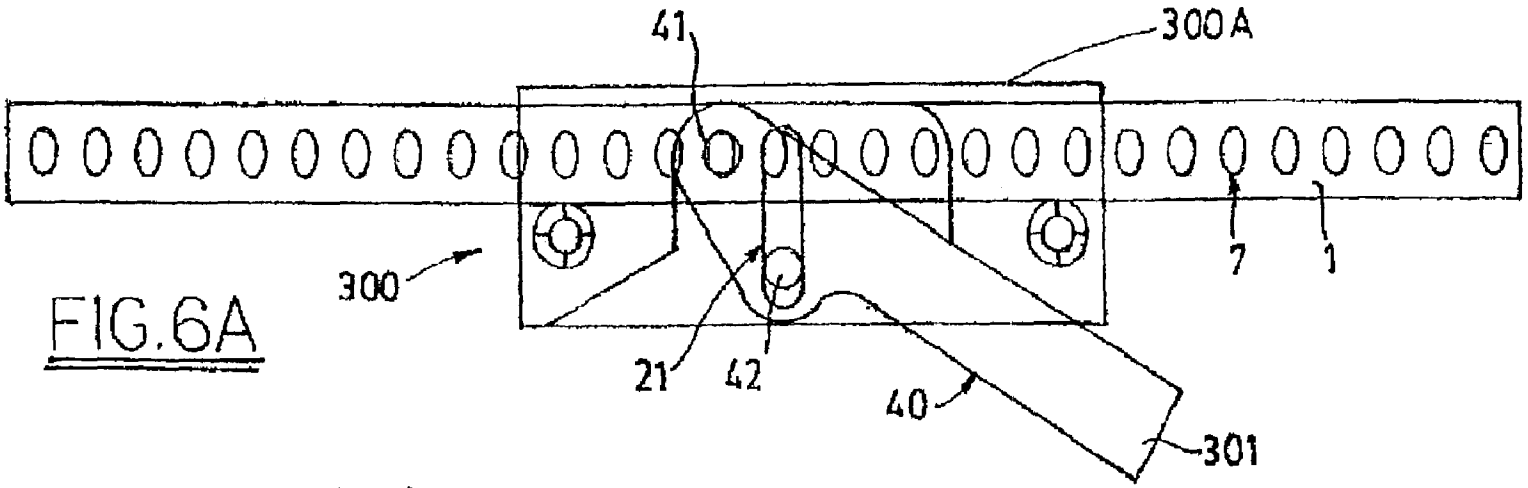
FIG. 6A provides a schematic cross-sectional view of the locking lever assembly in an open position.
Figure 6B:
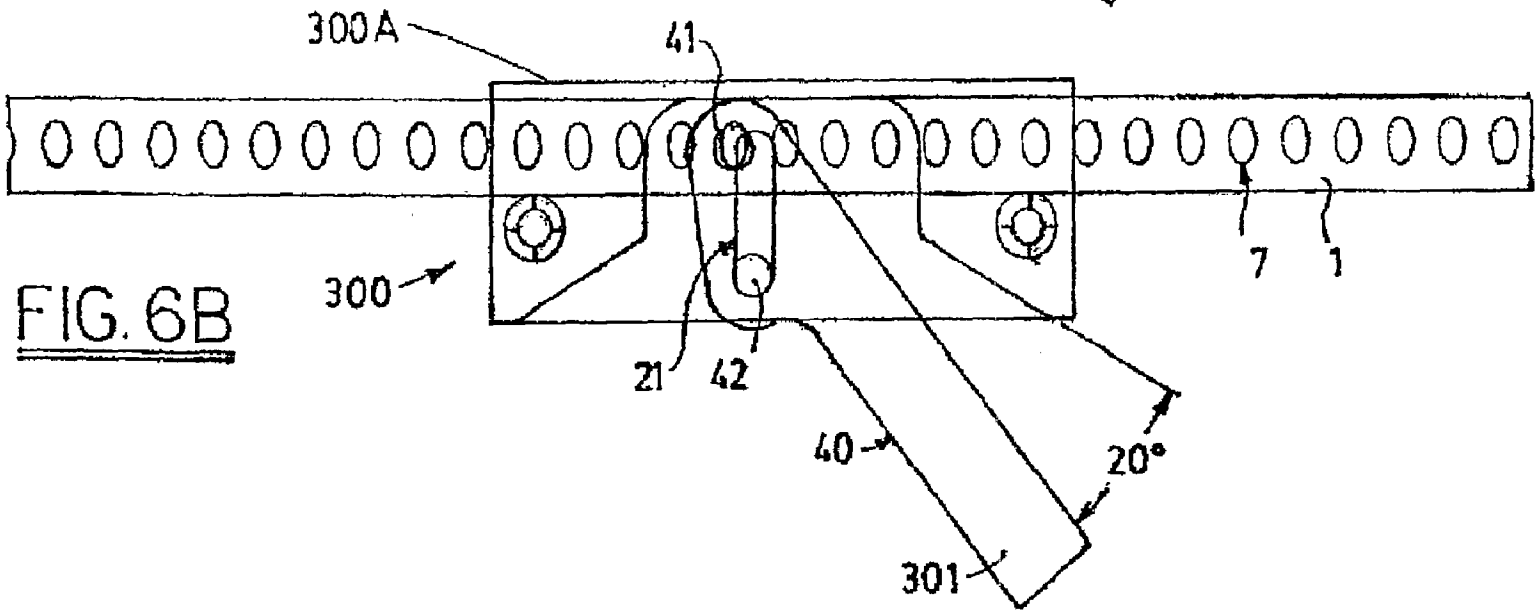
FIG. 6B provides a schematic cross-sectional view of the locking lever assembly after it has been moved 20 degrees towards a closed position.
Figure 6C:
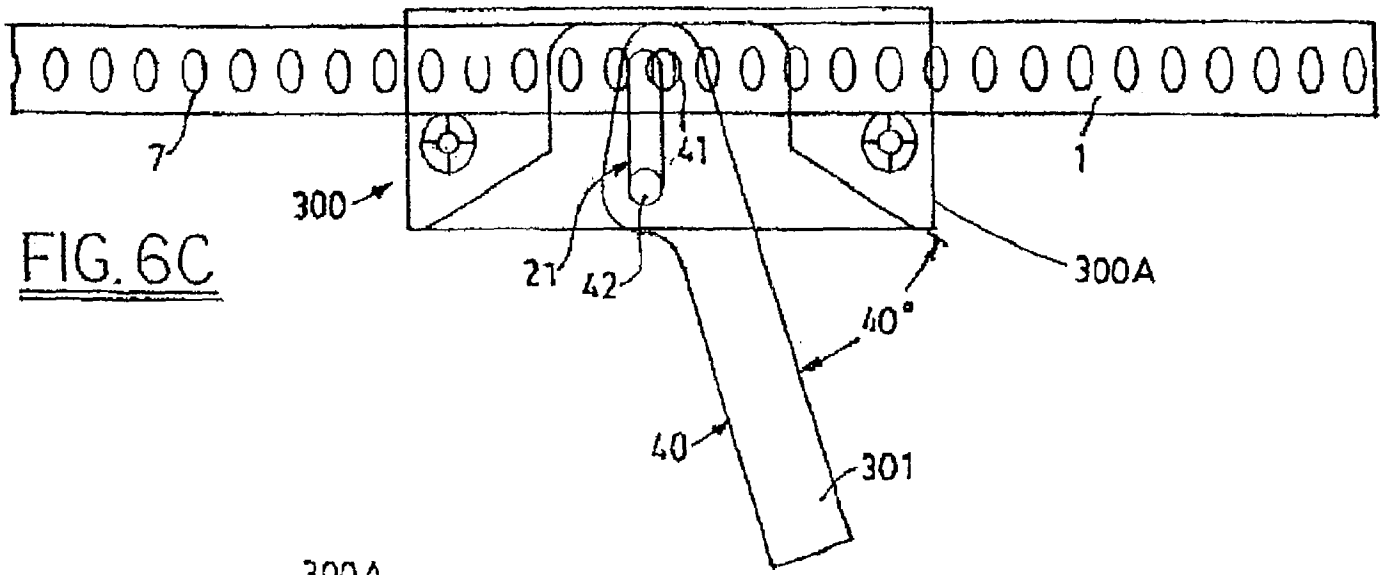
FIG. 6C provides a schematic cross-sectional view of the locking lever assembly after it has been moved 40 degrees towards a closed position.
Figure 6D:
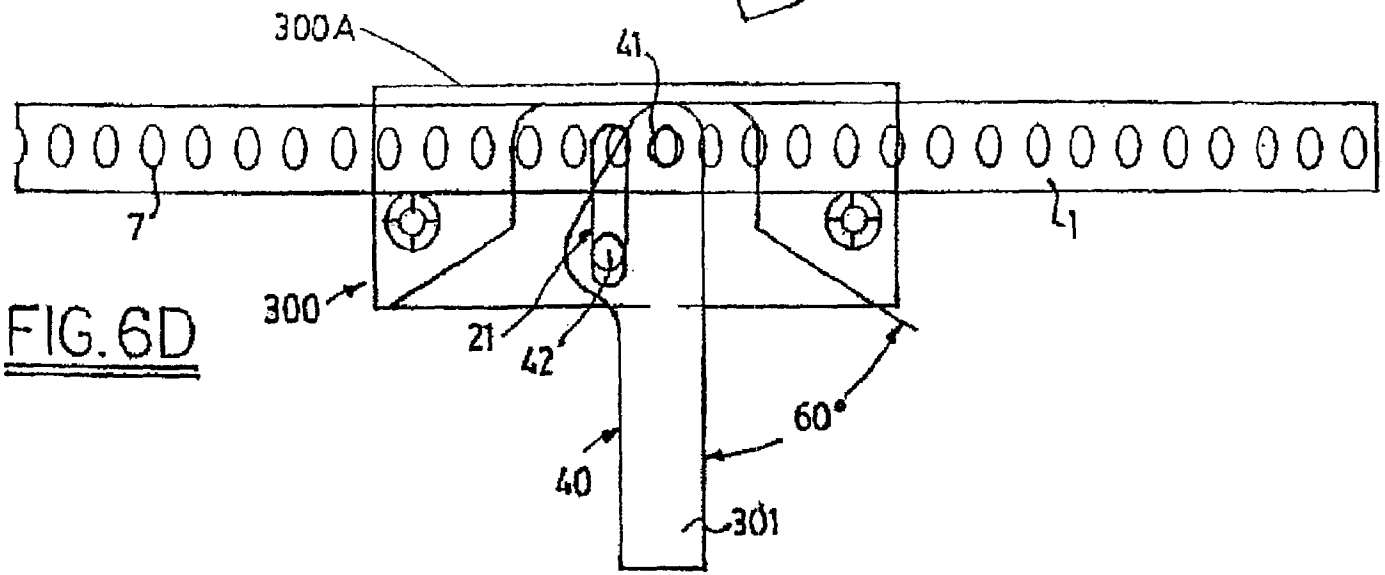
FIG. 6D provides a schematic cross-sectional view of the locking lever assembly after it has been moved 60 degrees towards a closed position.
Figure 6E:
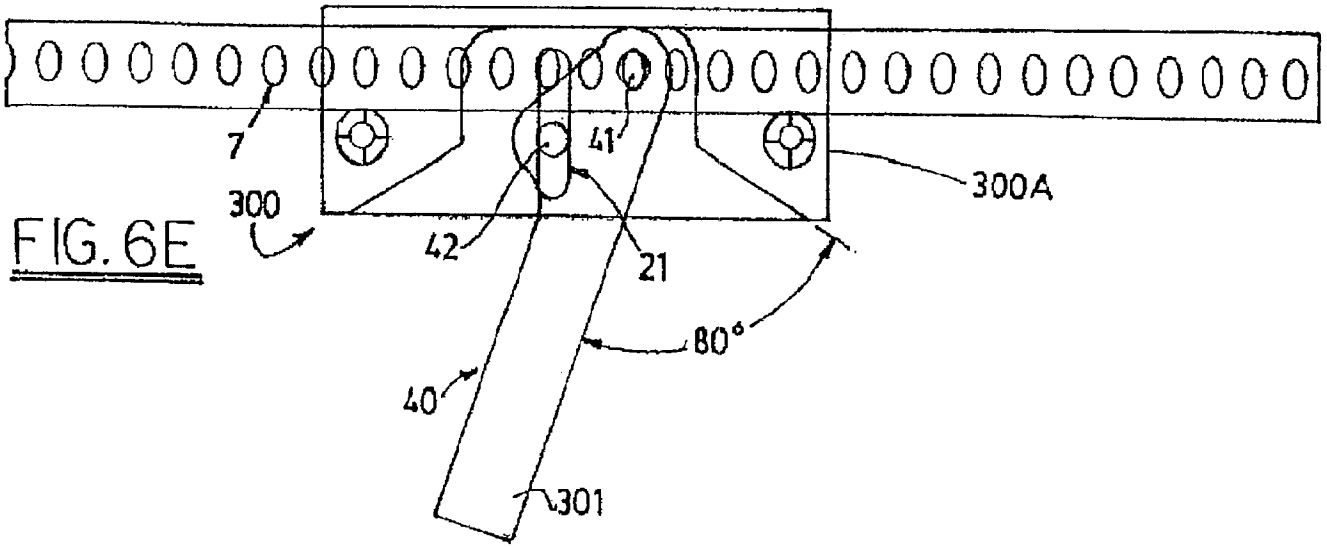
FIG. 6E provides a schematic cross-sectional view of the locking lever assembly after it has been moved 80 degrees towards a closed position.
Figure 6F:
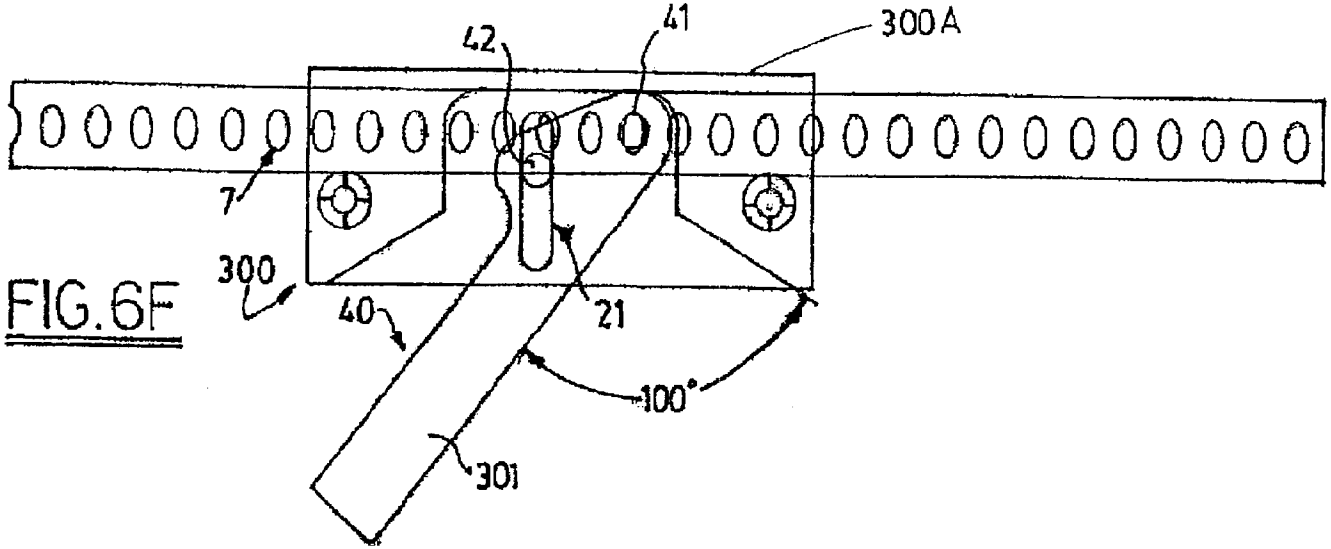
FIG. 6F provides a schematic cross-sectional view of the locking lever assembly after it has been moved 100 degrees towards a closed position.
Figure 6G:
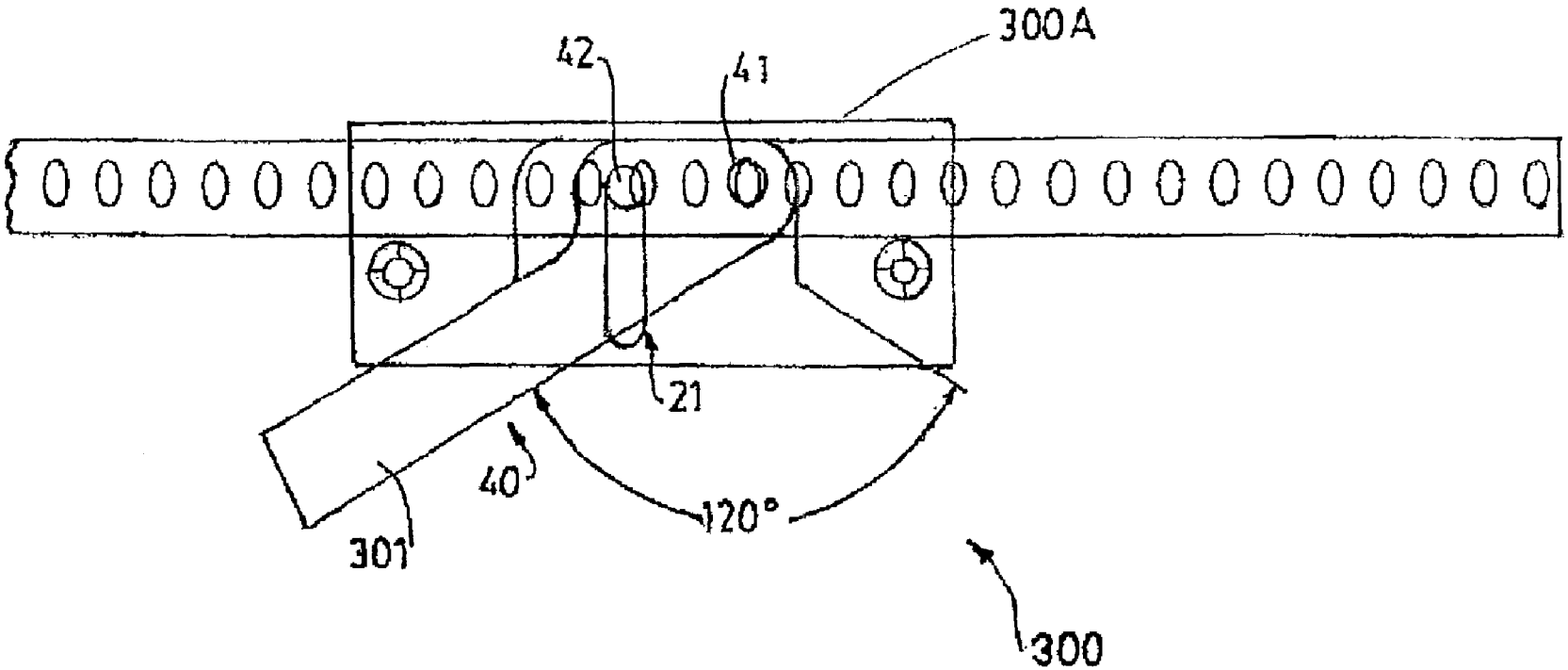

Tape 1 serves as the flexible push-pull member in my design. It starts at a locking lever assembly (denoted generally by arrow 300). In the embodiments of my invention illustrated in FIGS. 1 through 4B, locking lever assembly 300 is mounted on a windowsill 2 or at other locations on the frame (or perimeter) of a fenestration opening. Tape 1 can extend to as many locking pin assembly locations as desired. These could be placed all the way around the perimeter of a fenestration opening (e.g.—all the way around a window or doorframe). In most cases, however, a swinging sash or door will require only the installation of an upper locking pin assembly (denoted generally by arrow 100) and a lower locking pin assembly (denoted generally by arrow 200) on frame 4 in order to ensure that the sash or door is securely fastened when closed. Thus, in the preferred embodiments illustrated in FIGS. 1 through 3, tape 1 extends around the corner of a window frame via corner bracket 3 and upward along window frame 4 to upper locking pin assembly 100 and lower locking pin assembly 200.

In my invention, both locking pin assemblies 100, 200 can be substantially identical in terms of their form and parts. Instead of having a locking pin permanently affixed to tape 1, the locking pins 5 of these embodiments have collars 5A that trap the locking pins 5 in place within guides 6 mounted on frame 4. My locking pins 5 also have a coaxial motion transmitting pin 5B that extends into pin slots 7 in tape 1. (Only one pin slot 7 is denoted to avoid over-crowding of the drawing figures.) Collars 5A keep pins 5 trapped within guides 6 mounted to the casement side 4 so that pins 5 extend outward to engage or disengage keepers 8 on the sash, when their motion transmitting pins 5B are moved up and down by tape 1.

The elimination of any permanent connection between my locking pins 5 and tape 1 greatly simplifies the installation of my invention. It also allows upper locking pin assembly 100 and lower locking pin assembly 200 with their respective locking pins 5 to be mounted to engage various pin slots 7 in tape 1. Tape 1 can be provided in rolls and can easily be trimmed to the length desired. This allows my locking pin assemblies 100, 200 to be affixed at virtually any location along frame 4.

Thus, both locking pin assemblies 100, 200 and locking lever assembly 300 can be easily and simply positioned by the installer in any location desired or at any location dictated by the dimensional requirements of the fenestration opening. Some may choose to mount the locking lever assembly 300 between locking pin assemblies 100, 200 on frame 4. Ultimately, all a user needs for adding the fenestration locking system of my invention to almost any window or door in almost any configuration is: (1) a strip of perforated tape 1; (2) pins 5 for the keepers 8 on the window sash or door; (3) pin guides 6 for frame 4; (4) a corner bracket 3 for guiding the tape 1 at the corner of the window or door frame; (5) keepers 8 for the sash or door; and (6) some type of actuating member to move tape 1. The foregoing components can be advantageously manufactured from a variety of materials, including plastics and metallic materials.

The preferred actuating member for my invention is locking lever assembly 300, which can be seen to best advantage in FIGS. 5A through 7C. Locking lever assembly 300 includes a housing 300A formed from an upper piece 20 with a transverse slot 21 that is transverse to and above locking tape 1 and a lower piece 30 with a parallel slot 31 oriented in the direction of movement of the locking tape 1. The locking lever 40 of my locking lever assembly 300 has a handle 301 and a drive pin 41 opposite the handle 301 that extends downward through parallel slot 31 into one of the pin slots 7 of tape 1. Pivot pin 42 of locking lever 40 is offset towards handle 301 and extends upwards into the transverse slot 21 perpendicular to tape 1. The lever 40 is rotated, pivoting around drive pin 41, as it is moved to its locked position. In this process, pivot pin 42 moves first to one end of transverse slot 21 (see, FIG. 6A) and then reverses direction and moves to the other end of transverse slot 21. (See. FIGS. 6B–6G.) Meanwhile, tape drive pin 41 is pushed along in the direction of movement of tape 1. As FIGS. 6B and 6C make clear, transverse slot 21 must be at least equal to the distance between drive pin 41 and pivot pin 42.

This arrangement provides a low mechanical advantage and higher speed movement as the locking motion is commenced and a greatly increased mechanical advantage and slower speed movement as the locking pins 5 are driven home to pull a sash or door snuggly against its frame. The arrangement also aligns the drive pin 41 and the pivot pin 42 with the direction of movement of tape 1 when the sash is locked. In this position, it is not possible to pry into the edge of the window or door and push against locking pin(s) 5 or drive pin 41 and move tape 1 to an unlocked position.

Figure 7A:
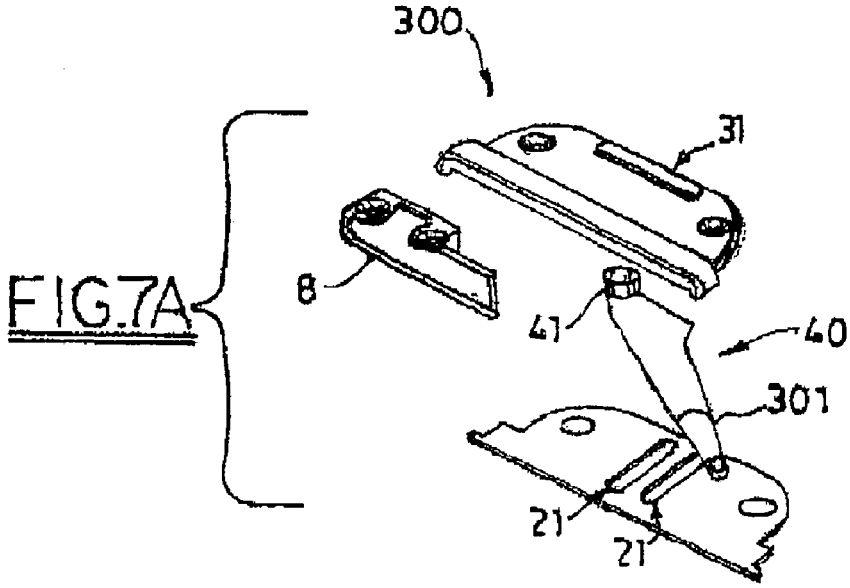
Figure 7B:
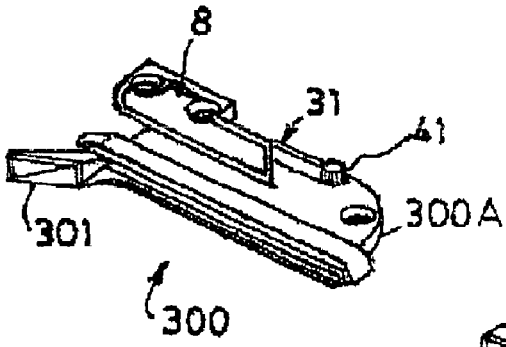
Figure 7C:
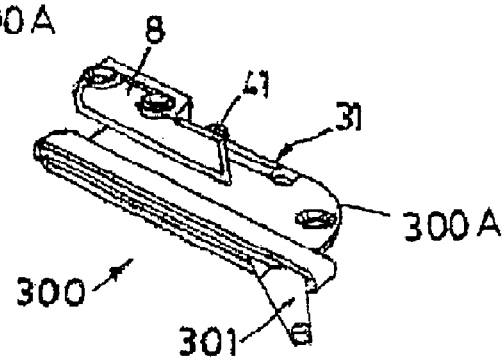
Figure 7D:
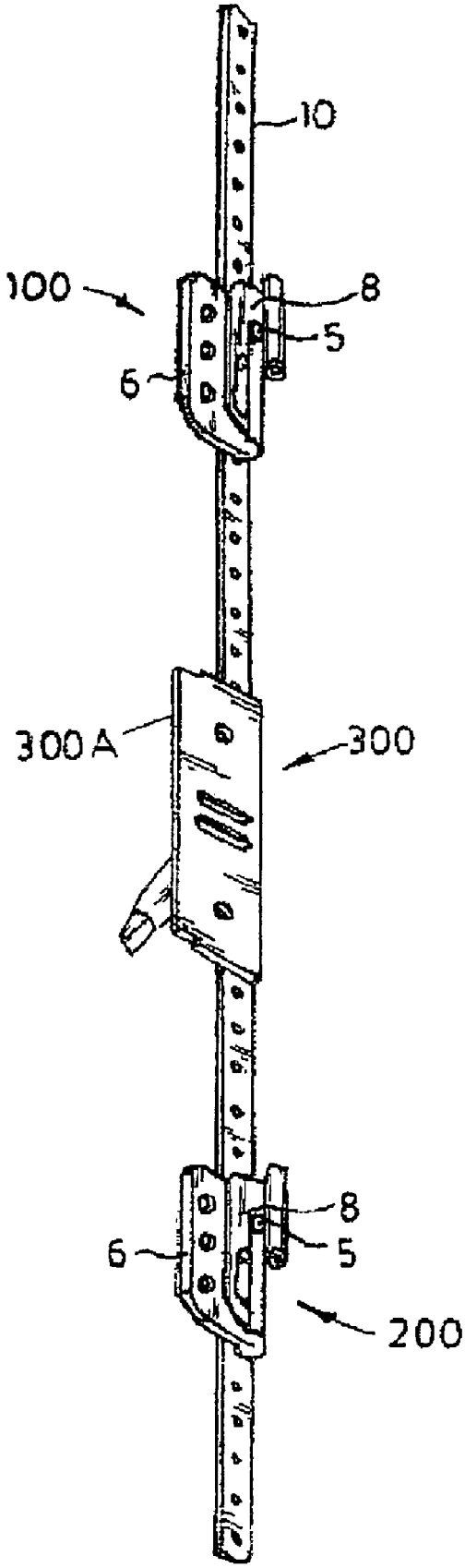
FIG. 7D illustrates a locking lever assembly used to drive a rigid lock bar.
Figures 8A, 8B:
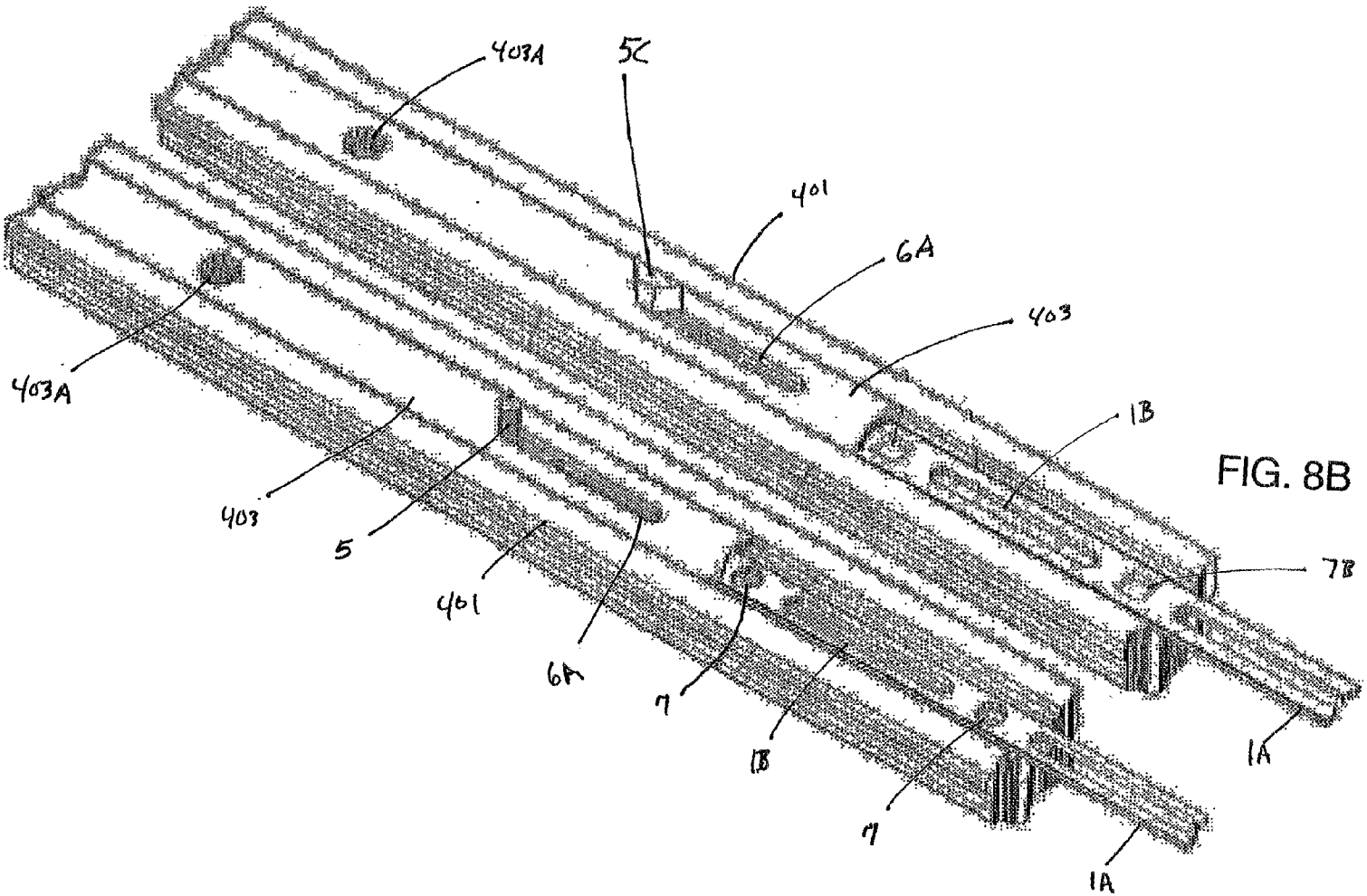
Figure 9A:
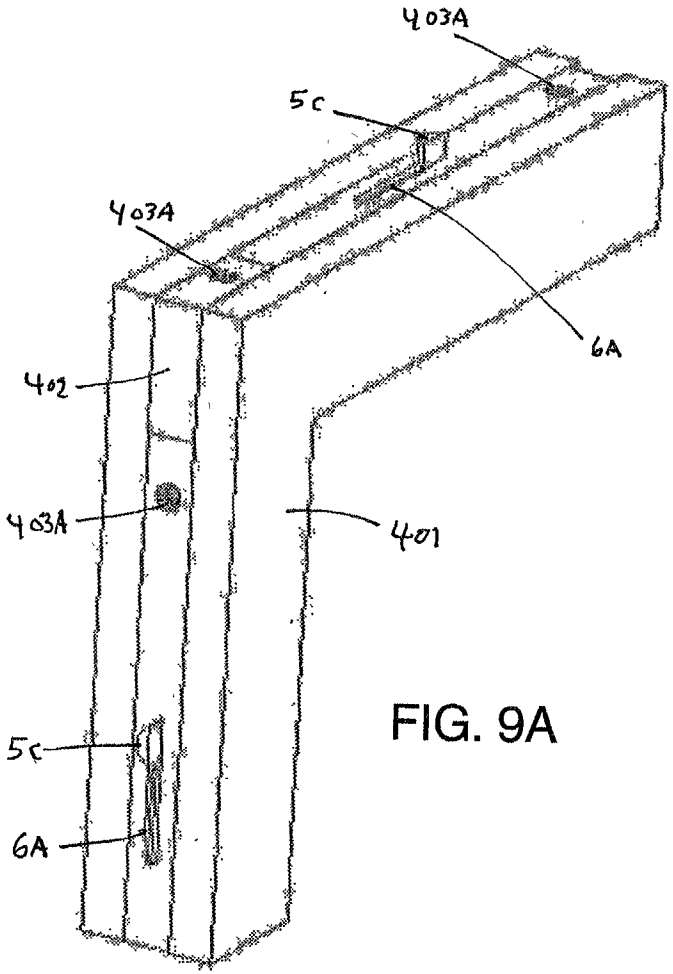
FIG. 9A provides a perspective view of the embodiment illustrated in FIG. 8B mounted at the corner of a fenestration closure means.
Figure 9B:
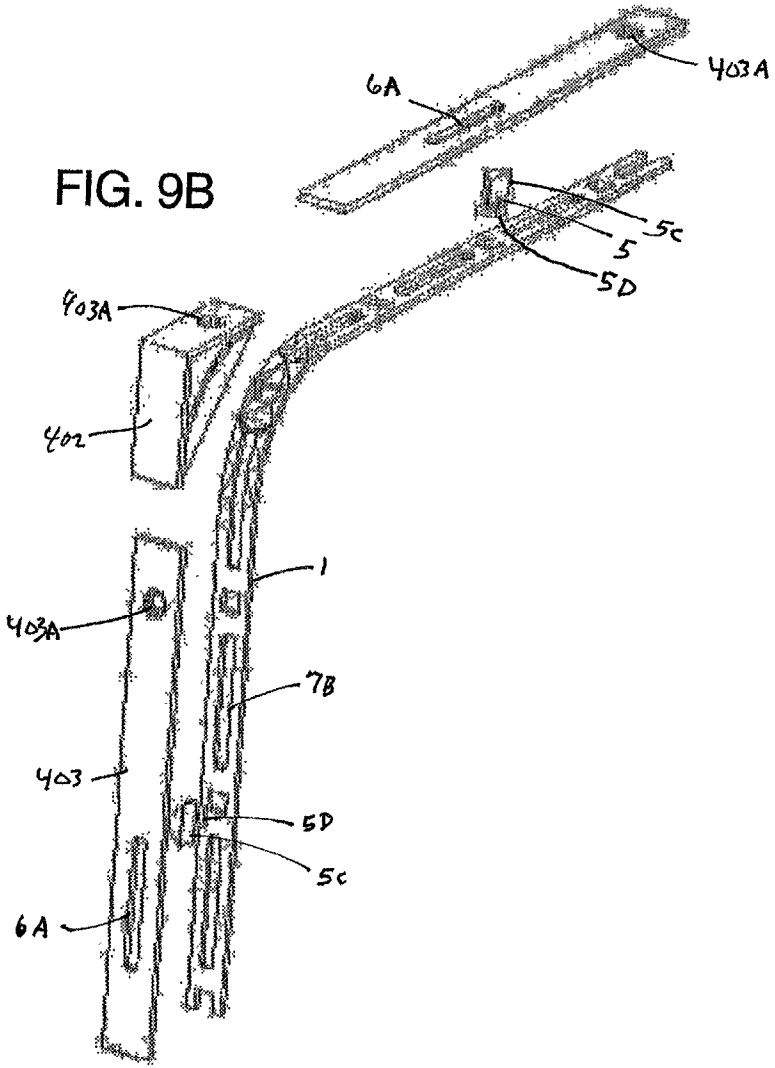
FIG. 9B provides an exploded view illustrating some of the elements extant in FIG. 9A.

As illustrated in FIGS. 7A, 7B, and 7C, my unique locking lever assembly 300 can also be used by itself without tape 1 as part of a fenestration locking system. In this situation, the orientation of my locking lever assembly 300 is reversed so that drive pin 41 projects outward. Drive pin 41 interfaces not with tape 1, but directly with keeper 8. As will be noted, the preferred embodiment illustrated also has two transverse slots 21. This allows the use of locking levers 40 adapted to open in either direction by using the transverse slot 21 suited to that locking lever 40. Alternatively, as illustrated in FIG. 7D, a locking lever assembly 300 assembled in the usual manner could be used to drive the type of rigid lock bar 10 typical in sash locking assemblies used with a swinging sash. In this circumstance, it could advantageously be mounted at the side of an enclosure between locking pin assemblies 100, 200.

In the embodiments of my invention illustrated in FIGS. 8A through 10B, the locking lever assembly (not shown) is mounted on a swinging sash or door mounted in a fenestration opening. The keeper (not shown) would be incorporated into the frame for the swinging sash or door. Modified tape 1A can extend to as many locking pin assembly locations around the perimeter of a swinging sash or door as desired. However, as was the case with the prior embodiments described, a swinging sash or door will usually require only the installation of an upper locking pin assembly (not shown) and a lower locking pin assembly (not shown) in order to ensure that the sash or door is securely fastened when closed.

Modified tape 1A of these embodiments is seated in a groove 400 in the edge of a door/sash 401. It extends around the corner of door/sash 401 and is held in place in the curved portion of groove 400 extending around the corner of door/sash 401 via a corner guide/cover 402. In general, however, it is held in place by cover strips 403. Cover strips 403 and modified tape 1A have specialized features to enable them to perform as required in this embodiment. First, the structure and positioning of cover strips 403 requires the use of fastening means positioned in a way that could, potentially, interfere with the function of modified tape 1A. The centrally positioned screw holes 403A of cover strips 403 require the placement of tape slots 1B in modified tape 1A in order to allow modified tape 1A to slide back and forth around screws fastening cover strips 403 to a door/sash 401 via screw holes 403A. Second, cover strips 403 serve the same general function as the guides 6 of the first embodiment. Thus, they must also be provided with slide slots 6A to allow pins 5 to be moved up and down by modified tape 1A. The keeper (not shown) for this embodiment will typically be incorporated into the frame for the fenestration opening with a gap in the frame allowing the locking pin 5 to be released and the sash or door to be unlocked.

Other possible variations in my invention are illustrated in FIGS. 8A through 13B. First, FIGS. 8B and 9B illustrate a variation of my invention having an enlarged wedge-shaped locking pin head 5C and an enlarged square coaxial motion transmitting pin 5D. (Wedge-shaped heads provide a mechanical advantage to the user when the head and the keeper are not completely aligned.) Square motion transmitting pin 5D fits into a square slot 7B in modified tape 1A. In this embodiment, pin 5 is fitted to slide slot 6A and is narrower than square motion transmitting pin 5D. (Thus, square motion transmitting pin 5D instead of a collar 5A serves to maintain the position of pin 5 under cover strip 403.) Second, in FIGS. 10A and 10B, two variations of cover strip 403 are illustrated. In the variation illustrated in FIG.

Figure 10B:
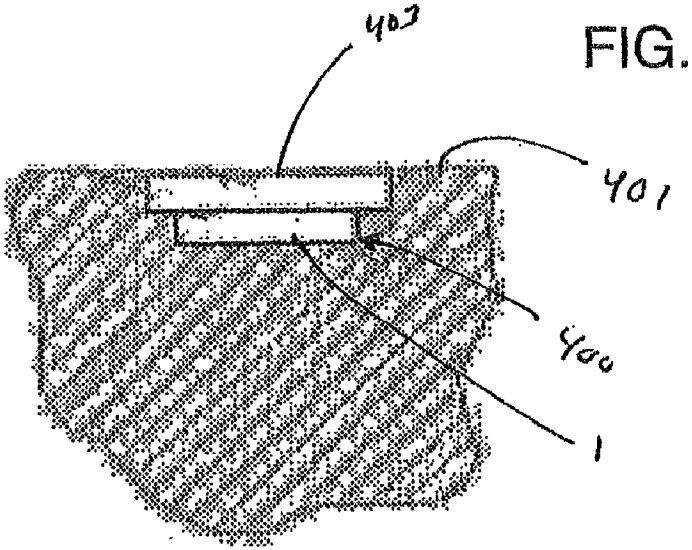
Figure 10A:
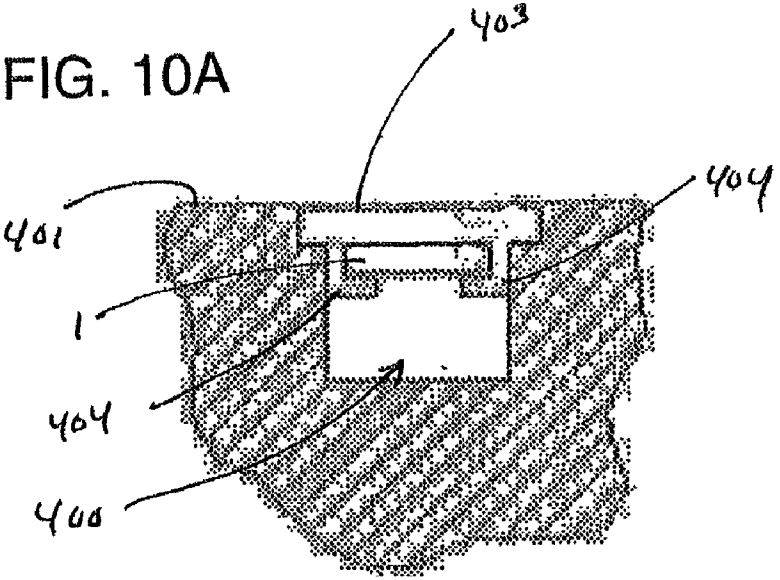
FIG. 10A provides a cross-sectional view of a first embodiment of the cover strip of my invention.
Figure 11A:
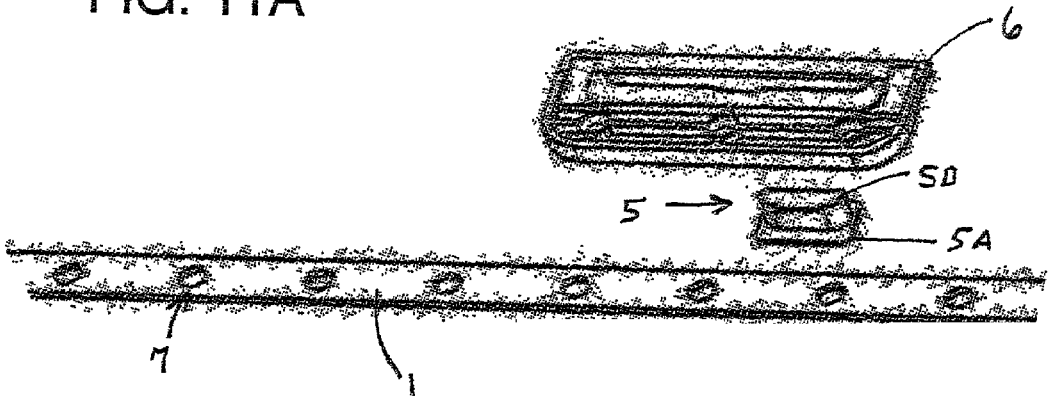
Figure 11B:
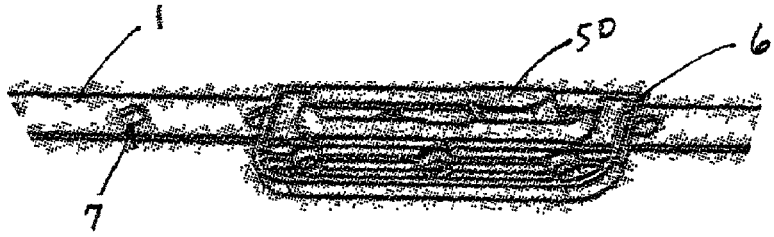
FIG. 11B provides an assembled view of the alternative locking pin and guide illustrated in FIG. 11A.
Figure 12A:
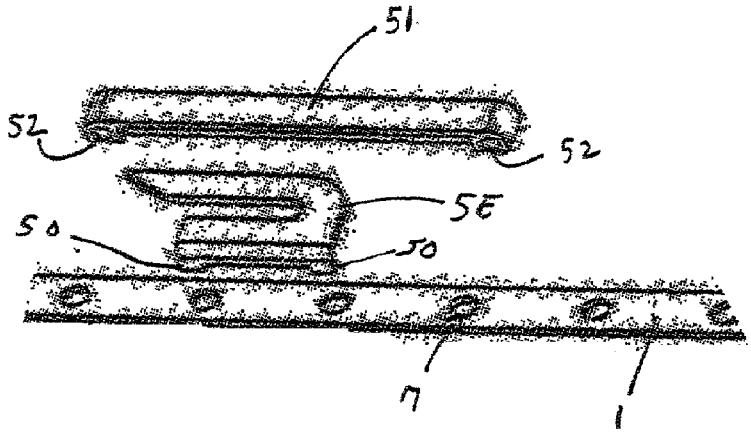
FIG. 12A provides an exploded perspective view of another alternative having a hook-shaped locking member with its guide.
Figure 12B:
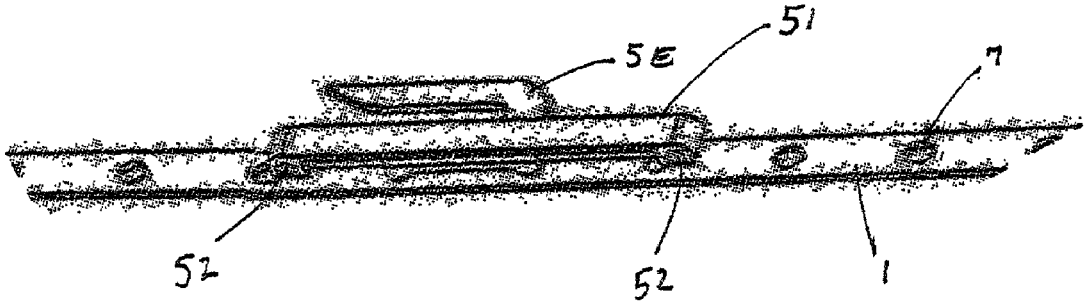
FIG. 12B provides an assembled view of the alternative hook-shaped locking member and guide illustrated in FIG. 12A.
Figure 13A:
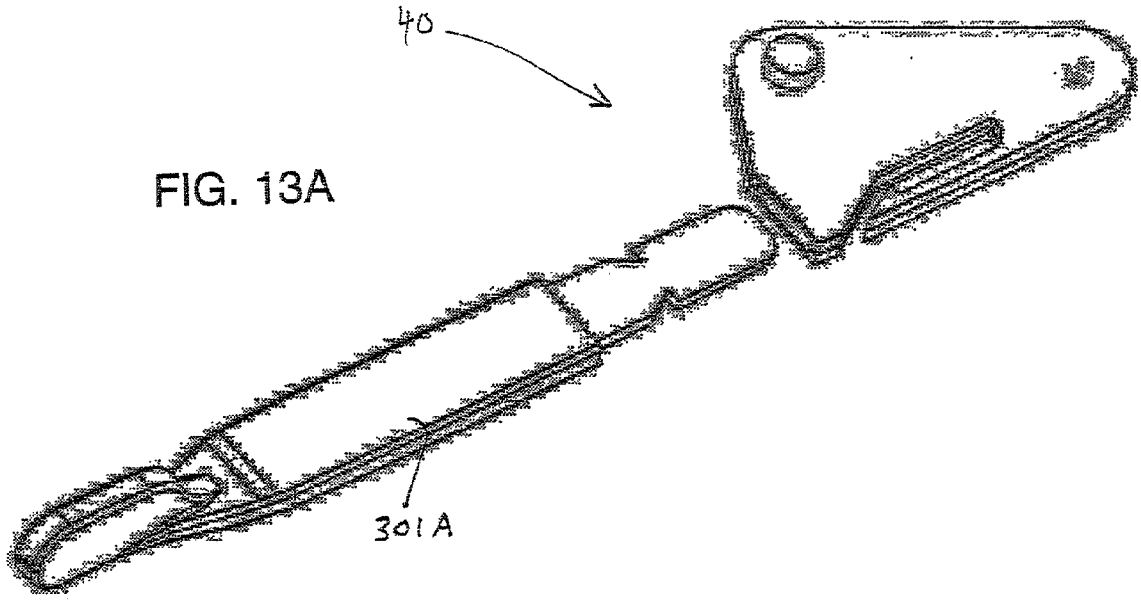
FIG. 13A provides a perspective disassembled view of a two-part locking lever with a separable snap-in handle.
Figure 13B:
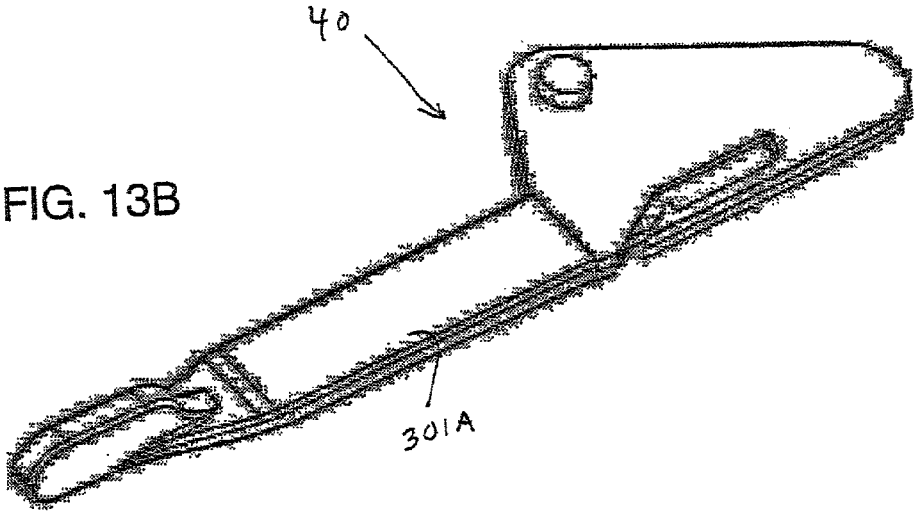

10A, modified tape 1A rests in a slot under cover strip 403 created by "L"-shaped extensions 404. This variation is suitable for placement in existing grooves 400 that may be too large to easily serve the purposes of this invention. Another variation is illustrated in FIG. 10B. In this variation, cover strip 403 is formed for placement over a groove 400 that is more closely tailored for the purposes of this invention; thus, extensions 404 are unnecessary. Third, FIGS. 11A and 11B illustrate an embodiment with a pin 5 having a more elongate wedge-shaped head 5D and a rectangular collar 5A. Fourth, FIGS. 12A and 12B illustrate an embodiment having a hook-shaped head 5E with two tabs 50 by which it interacts with tape 1. As the "pin" (hook-shaped head 5E) for this embodiment is shaped like a "keeper", the keepers for this embodiment can advantageously be pin- or wedge-shaped. This embodiment uses a side screw guide 51 that can be pressed down onto and fastened directly above the hook-shaped head 5E so as to hold hook-shaped head 5E in position. The embodiment illustrated uses screws that are placed into screw holes 52 that penetrate the side of a frame or structure on which this embodiment is mounted rather than being placed through or along side of tape 1. Fifth, FIGS. 13A and 13B illustrate a two-part locking lever 40 with a separable snap-in handle 301A. This option allows for an easily removed handle for both painting and changing colors of the hardware. The foregoing variations and embodiments should not, however, be seen as exhaustive. The inventive concepts underlying my invention can give rise to numerous variations without exceeding the scope of my invention as better defined by the claims that follow.

I claim:

1. A fenestration locking system for a swinging sash or door, comprising:

a) a flexible linear push-pull member, which flexible linear push-pull member is substantially and uniformly flexible throughout its entire length and has multiple actuator engagement sites along its length;

b) a keeper c) a locking pin assembly, which locking pin assembly has a moveable locking pin and a guide, the moveable locking pin having an actuator that engages at least one of the multiple actuator engagement sites on the flexible linear member when held in position thereon by the guide such that said flexible linear member can then cause said locking pin to move with respect to said locking pin assembly so that an extension engages the keeper when said flexible linear member is moved in a first direction and so that said extension disengages the keeper when said flexible linear member is moved in a second direction; and d) an actuating assembly, which actuating assembly is used to move said flexible linear member in said first direction and in said second direction, wherein said actuating assembly is comprised of a substantially rigid lever arm with an actuating handle for movement of the lever arm at one end and a drive member at an other end opposite therefrom, the handle not being pivotally connected to said housing other than by said lever arm, the lever arm pivoting about said drive member when the handle is moved, which drive member is slideable in a drive member slot parallel to said flexible linear member and which drive member engages said flexible linear member at one of said multiple actuator engagement sites.

2. A fenestration locking system for a swinging sash or door as described in claim 1, wherein said locking pin assembly is mounted on a fenestration frame and said keeper is oppositely mounted on a window or door mounted in said fenestration frame.

3. A fenestration locking system for a swinging sash or door as described in claim 2, wherein said flexible linear member and actuating assembly are mounted on the fenestration frame.

4. A fenestration locking system for a swinging sash or door as described in claim 1, wherein said keeper is incorporated into a fenestration frame and said locking pin assembly is opposingly mounted on a window or door mounted in said fenestration frame.

5. A fenestration locking system for a swinging sash or door as described in claim 4, wherein said flexible linear member and actuating assembly are incorporated into the window or door mounted in said fenestration frame.

6. A fenestration locking system for a swinging sash or door as described in claim 1, wherein said guide holds said locking pin and said flexible linear member in operative positions.

7. A fenestration locking system for a swinging sash or door as described in claim 6, wherein said guide is inset into a swinging door or sash over said locking pin and said flexible linear member.

8. A fenestration locking system for a swinging sash or door as described in claim 1, wherein said engagement sites are perforations in said flexible linear member.

9. A fenestration locking system for a swinging sash or door as described in claim 8, wherein said actuator has an engagement member that inserts into one of said perforations.

10. A fenestration locking system for a swinging sash or door as described in claim 1, further including a corner member for mounting at a corner of a window or door frame, which corner member guides said flexible linear member around said corner from said actuating assembly to said locking pin assembly.

11. A fenestration locking system for a swinging sash or door as described in claim 1, further including a corner assembly for a corner of a window or door, which corner assembly guides said flexible linear member around said window or door corner from said actuating assembly to said locking pin assembly.

12. A fenestration locking system for a swinging sash or door as described in claim 1, wherein said locking pin moves in a slide slot in said locking pin assembly when moved by said flexible linear member.

13. A fenestration locking system for a swinging sash or door as described in claim 1, wherein said locking pin has a collar by which it is maintained in said locking pin assembly.

14. A fenestration locking system for a swinging sash or door as described in claim 9, wherein said locking pin has an enlarged engagement member by which it is maintained in said locking pin assembly.

15. A fenestration locking system for a swinging sash or door as described in claim 1, wherein said lever arm also has a pivot member, which pivot member is slideable in a pivot member slot transverse to said flexible linear member.

16. A fenestration locking system for a swinging sash or door as described in claim 15, wherein said pivot member is aligned with said drive member slot when the locking system is locked.

17. A fenestration locking system for a swinging sash or door as described in claim 16, wherein said pivot member slot and said drive member slot overlap.

18. A fenestration locking system for a swinging sash or door as described in claim 1, wherein said lever arm has a detachable handle.

19. A fenestration locking system for a swinging sash or door as described in claim 1, wherein said locking pin is hook shaped and said keeper is shaped to engage said hook-shaped locking pin.

20. A fenestration locking system for a swinging sash or door, comprising:

a) a linear member with multiple engagement sites along its length; and b) an actuating assembly having a housing with a substantially rigid lever arm moveable with respect to said housing, which lever arm has an actuating handle for movement of the lever arm at one end and a drive member at an other end opposite therefrom, the handle not being pivotally connected to said housing other than by said lever arm, the lever arm pivoting about said drive member when the handle is moved, which drive member is slideable in a drive member slot in said housing parallel to said linear member and which drive member can engage said linear member at one of said multiple engagement sites such that said lever arm can then cause said linear member to move with respect to said actuating assembly, and wherein said lever arm also has a transverse pivot member, which pivot member is substantially parallel to said drive member and is slideable in a pivot member slot in said housing transverse to said linear member.

21. A fenestration locking system for a swinging sash or door as described in claim 20, wherein said engagement sites are perforations in said linear member.

22. A fenestration locking system for a swinging sash or door as described in claim 21, wherein said drive member inserts into one of said perforations.

23. A fenestration locking system for a swinging sash or door as described in claim 20, wherein said linear member is flexible.

24. A fenestration locking system for a swinging sash or door as described in claim 20, wherein said linear member is rigid.

25. A fenestration locking system for a swinging sash or door as described in claim 20, further comprising a keeper locking pin attached to said linear member.

26. A fenestration locking system for a swinging sash or door as described in claim 20, wherein said pivot member is aligned with said drive member slot when the locking system is locked.

27. A fenestration locking system for a swinging sash or door as described in claim 26, wherein said pivot member slot and said drive member slot overlap.

28. A fenestration locking system for a swinging sash or door as described in claim 20, wherein said lever arm has a detachable handle.

29. A fenestration locking system for a swinging sash or door as described in claim 25, wherein said keeper locking pin is hook shaped.

30. A fenestration locking system for a swinging sash or door, comprising:

a) a keeper; and b) an actuating assembly having a housing with a substantially rigid lever arm moveable with respect to said housing, which lever arm has an actuating handle for movement of the lever arm at one end and a drive member at an other end opposite therefrom, the handle not being pivotally connected to said housing other than by said lever arm, the lever arm pivoting about said drive member when the handle is moved, which drive member is slideable in a drive member slot in said housing and can engage said keeper, and wherein said lever arm also has a transverse pivot member, which pivot member is substantially parallel to said drive member and is slideable in a pivot member slot in said housing transverse to said drive member slot.

31. fenestration locking system for a swinging sash or door as described in claim 30, wherein said pivot member is aligned with said drive member slot when the locking system is locked.

32. A fenestration locking system for a swinging sash or door as described in claim 31, wherein said pivot member slot and said drive member slot overlap.

33. A fenestration locking system for a swinging sash or door as described in claim 30, wherein said lever arm has a detachable handle.

34. A fenestration locking system for a swinging sash or door, comprising:

a) a linear member with multiple engagement sites along its length; and b) an actuating assembly having a housing with a lever arm moveable with respect to said housing, which lever arm is pivotable about a drive member, which drive member is slideable in a drive member slot in said housing parallel to said linear member and which drive member can engage said linear member at one of said multiple engagement sites such that said lever arm can then cause said linear member to move with respect to said actuating assembly, and wherein said lever arm also has a transverse pivot member, which pivot member is substantially parallel to said drive member and is slideable in a linear path in a pivot member slot in said housing transverse to said linear member.

35. A fenestration locking system for a swinging sash or door, comprising:

a) a keeper; and b) an actuating assembly having a housing with a lever arm moveable with respect to said housing, which lever arm has an actuating handle for movement of the lever arm at one end and a drive member at an other end opposite therefrom, the handle not being pivotally connected to said housing other than by said lever arm, the lever arm being pivotable about said drive member, which drive member is slideable in a drive member slot in said housing and can engage said keeper, and wherein said lever arm also has a transverse pivot member, which pivot member is substantially parallel to said drive member and is slideable in a linear path in a pivot member slot in said housing transverse to said drive member slot.

* * * * *

UNITED STATES PATENT AND TRADEMARK OFFICE

CERTIFICATE OF CORRECTION

PATENT NO. : 7,004,515 B2
DATED : February 28, 2006
INVENTOR(S) : E. Erik Timothy It is certified that error appears in the above-identified patent and that said Letters Patent is hereby corrected as shown below:

Column 7,
Line 39, replace “keeper” with -- keeper; --.

Column 10,
Line 16, replace “fenestration” with -- A fenestration --.

Signed and Sealed this

Second Day of May, 2006

JON W. DUDAS
*Director of the United States Patent and Trademark Office*